US006733103B2

(12) United States Patent
Murata

(10) Patent No.: US 6,733,103 B2
(45) Date of Patent: May 11, 2004

(54) PRINTER

(75) Inventor: Akikazu Murata, Akiruno (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 10/092,853

(22) Filed: Mar. 7, 2002

(65) Prior Publication Data

US 2002/0130913 A1 Sep. 19, 2002

(30) Foreign Application Priority Data

Mar. 13, 2001 (JP) ..... 2001-070811

(51) Int. Cl.[7] ..... B41J 29/38; B41J 29/377
(52) U.S. Cl. ..... 347/14; 347/18
(58) Field of Search ..... 347/14, 18

(56) References Cited

U.S. PATENT DOCUMENTS 5,512,924 A * 4/1996 Takada et al. ..... 347/18
5,676,475 A * 10/1997 Dull ..... 400/174
5,736,995 A * 4/1998 Bohorquez et al. ..... 347/14
6,283,650 B1 * 9/2001 Yamada et al. ..... 400/120.14
6,476,928 B1 * 11/2002 Barbour et al. ..... 358/1.15
6,575,547 B2 * 6/2003 Sakuma ..... 347/18

FOREIGN PATENT DOCUMENTS

JP 07-025038 A 1/1995 ..... B41J/2/21
JP 2000-203014 A 7/2000 ..... B41J/2/145

* cited by examiner

*Primary Examiner*—Stephen D. Meier
*Assistant Examiner*—Alfred Dudding
(74) *Attorney, Agent, or Firm*—Frishauf, Holtz, Goodman & Chick, P.C.

(57) ABSTRACT

An inkjet printer is provided which includes a carriage that has a plurality of print heads and that reciprocates with respect to a recording sheet, a printer main body having a main power supply, and a cable that establishes electric conduction between the main power supply and the plurality of print heads. In addition, a voltage generating unit that generates head drive voltages according to the plurality of print heads from a voltage supplied from the main power supply is provided on the carriage.

2 Claims, 5 Drawing Sheets

PRINTER

CROSS-REFERENCE TO RELATED APPLICATIONS

This application is based upon and claims the benefit of priority from the prior Japanese Patent Application No. 2001-070811, filed Mar. 13, 2001, the entire contents of which are incorporated herein by reference.

BACKGROUND OF THE INVENTION

1. Field of the Invention

The present invention relates to a print apparatus such as a printer, and the like, and more particularly, to a printer such as an inkjet printer, and the like arranged such that inkjet heads are mounted on a carriage and power is supplied from a printer main body side to the carriage through cables.

2. Description of the Related Art

Conventionally, it is sometimes a case that inkjet printers have a plurality of print heads mounted thereon to eject inks having a different color for the purpose of making multi-color print, and so on.

In this case, a power supply having a sufficient electric power is disposed to the printer main body side to perform recording by driving the plurality of print heads at the same time. The plurality of print heads are connected to the printer main body side through many power supply lines and control signal lines.

An example of an arrangement of an inkjet printer according the conventional art will be described here with reference to FIG. 1 showing the example. FIG. 1 shows the arrangement of the inkjet printer which performes recording by driving a plurality of print heads 111-1 to 111-6 at the same time. That is, a main power supply 104 is mounted on a printer main body 101 side. The main power supply 104 is connected to a plurality of voltage converters 109-1 to 109-6.

The outputs of the voltage converters 109-1 to 109-6 are connected to the inputs of head drive units 110-1 to 110-6, respectively. Further, a CPU 105 is mounted on the main body 101 to control the inkjet printer in its entirety. The control signal lines of the CPU 105 are connected to a head voltage controller 108, an image data processing unit 106, and a head drive controller 107, respectively. The printer main body 101 arranged as described above is connected to a carriage 103 side through a cable 102 so as to freely communicate therewith.

The plurality of print heads 111-1 to 111-6 are mounted on the carriage 103. The power supply lines and control signal lines are connected to the print heads 111-1 to 111-6, respectively. Further, the outputs from temperature detectors (not shown) included in the print heads 111-1 to 111-6 are fed back to the CPU 105 on the printer main body 101 side (hereinafter, this arrangement is referred to as prior art 1).

Nowadays, there have been also developed printers having a head voltage generation circuit disposed in each of print heads to generate a drive voltage for driving each print head. It is also contemplated to dispose the head voltage generation circuits the print heads, as described above (hereinafter, this arrangement is referred to as prior art 2).

Jpn. Pat. Appln. KOKAI Publication No. 7-25038, for example, discloses a technology of an inkjet recording apparatus that is roughly divided into a recording device section (mainly composed of print heads, and a carriage on which the print heads are mounted) and a machine main body (mainly composed of a power supply, respective control circuits, and respective head drive circuits) in which the drive of the recording apparatus section is controlled from the machine main body side. In this technology, the print heads are driven and controlled by electrically connecting the machine main body side to the recording device section through cables so as not to interfere with the movement of the carriage.

In this technology, a cable for connecting the machine main body side to the carriage side contains a control signal line and a power supply line for one set of the print heads, and it further contains a print head selection signal line. Therefore the number of control signal lines and voltage supply lines is reduced. That is, machine main body select one of the plurality of recording heads which is used for recording by using the the print head selection line, and a control signal and a drive voltage are supplied only to the selected print head (hereinafter, this arrangement is referred to as prior art 3).

Jpn. Pat. Appln. KOKAI Publication No. 2000-203014 discloses a technology of an inkjet printer having a head, a carriage, and a head drive circuit, wherein the head drive circuit has a plurality of selection units, which are connected to respective piezo electric elements and can receive drive signals, a controller which controls the selection units, and a plurality of voltage/current amplifiers which amplify the drive signals that are supplied to the piezo electric elements (hereinafter, this arrangement is referred to as prior art 4).

However, the prior art 1 has a problem in that while it is provided with the plurality of print heads to realize multi-gradation recording, when the print heads are driven at the same time, the number of the control signal lines and the power supply lines of the cable 102 increases as the number of the print heads 111-1 to 111-6 increases.

That is, since the print heads 111-1 to 111-6 must be individually controlled, it is necessary to provide the control signal lines according to the number of the print heads, which results in an increase in the number of the control signal lines. Further, when a different drive voltage is supplied to each drive head, the power supply lines must be provided according to the number of the print heads, which results in an increase in the number of the power supply lines.

Further, while the length of the cable 102 is determined according to the moving range of the carriage 103, the length thereof must be increased in a printer which prints a larger image because the carriage 103 moves in a wider range. In this case, a predetermined drive voltage cannot be supplied to the print heads 111-1 to 111-6 because the drive voltage generated on the printer main body 101 side is dropped by the resistance component and the inductance component of the cable 102 itself before it is supplied to the print heads 111-1 to 111-6 through the cable 102.

To solve this problem, it is contemplated to generate the drive voltage on the machine main body side at a higher level in consideration of the drop thereof.

However, this is against a today's requirement for reducing power consumption.

Further, when it is desired to abruptly apply a large drive voltage is to the print heads, the long cable interfere contribute to make the rise time of the drive voltage longer. Accordingly, there is a possibility that the print heads cannot be driven at predetermined timing.

In the arrangement of the prior art 2, the temperature of the print heads themselves is excessively increased by the heat generated by the head voltage generating circuits disposed in the print heads. Thus, there is a possibility that ink ejection characteristics are made abnormal when inks are ejected and the quality of a recorded image is deteriorated thereby.

Further, each print head is not designed specifically for a particular ink but has versatility such that it can cope with a plurality of ink colors. With this design, a voltage generate circuit that constitutes a part of the head voltage generation circuit disposed in each print head also has versatility.

Therefore, when it is desired to differently control a voltage for each color, means for externally supplying ink color information, and the like to the voltage control circuit is necessary. Without this means, it is impossible the control the voltage for each ink color.

That is, when it is desired to differently control the voltage for each ink, it is necessary to separately supply ink color information to the voltage control circuit in each print head.

According to the arrangement as shown in the prior art 3, it is impossible to execute simultaneous print by the plurality of print heads, and further it is also impossible to execute recording at a high speed while the number of the control signal lines and the power supply lines in the cable can be reduced.

The prior art 4 describes nothing as to the number of the power supply lines when a plurality of print heads are employed. When it is desired to set a desired drive voltage to each print head, an infinite number of power supply lines must be prepared to supply a different voltage, which means an increase in the number of the power supply lines.

BRIEF SUMMARY OF THE INVENTION

An object of the present invention, which was made in view of the above problems, is to provide an inkjet printer capable of reducing the number of cables of a carriage with a plurality of print heads, maintaining the versatility of the print heads, and recording an image having desired high quality while realizing simultaneous printing executed by the print heads.

More specifically, an object of the present invention is to reduce the number of power supply lines, and the like that constitute a cable by disposing a voltage generating unit, which generates a head drive voltage according to each of a plurality of inkjet heads from a voltage supplied from a main power supply, on a carriage side. Another object of the present invention is to realize simultaneous printing executed by a plurality of print heads, and is to control the voltages of each ink colors by permitting the voltage generation unit to optionally set a drive voltage to each inkjet head and to optionally convert the set voltage regardless of a voltage supplied from the main power supply. Still another object of the present invention is to print an image having desired high quality to which temperature information is added by providing a head temperature detector with each inkjet head.

To achieve the above objects, according to a first aspect of the present invention, there is provided a printer comprising: a carriage having a plurality of print heads mounted thereon and reciprocating with respect to a recording sheet; a main power supply disposed on a printer main body side; and a cable which establishes electric conduction between the main power supply and the plurality of print heads, wherein a voltage generating unit, which generates head drive voltages according to the plurality of print heads from the voltage supplied from the main power supply, is disposed on the carriage.

According to a second aspect of the present invention, there is provided a printer comprising: a printer main body; a carriage moving relatively to a recording medium; a power supply/communication cable which connects the printer main body to the carriage, wherein the printer main body comprises a main power supply and a master CPU; the carriage comprises a plurality of print heads and a voltage generating unit which generates head drive voltages according to the plurality of print heads; and the power supply/communication cable supplies a predetermined command from the master CPU and a voltage from the main power supply to the voltage generating unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiment of the invention, and together with the general description given above and the detailed description of the embodiment given below, serve to explain the principles of the invention.

DETAILED DESCRIPTION OF THE INVENTION

An embodiment of the present invention will be described below with reference to the drawings.

Figure 1:
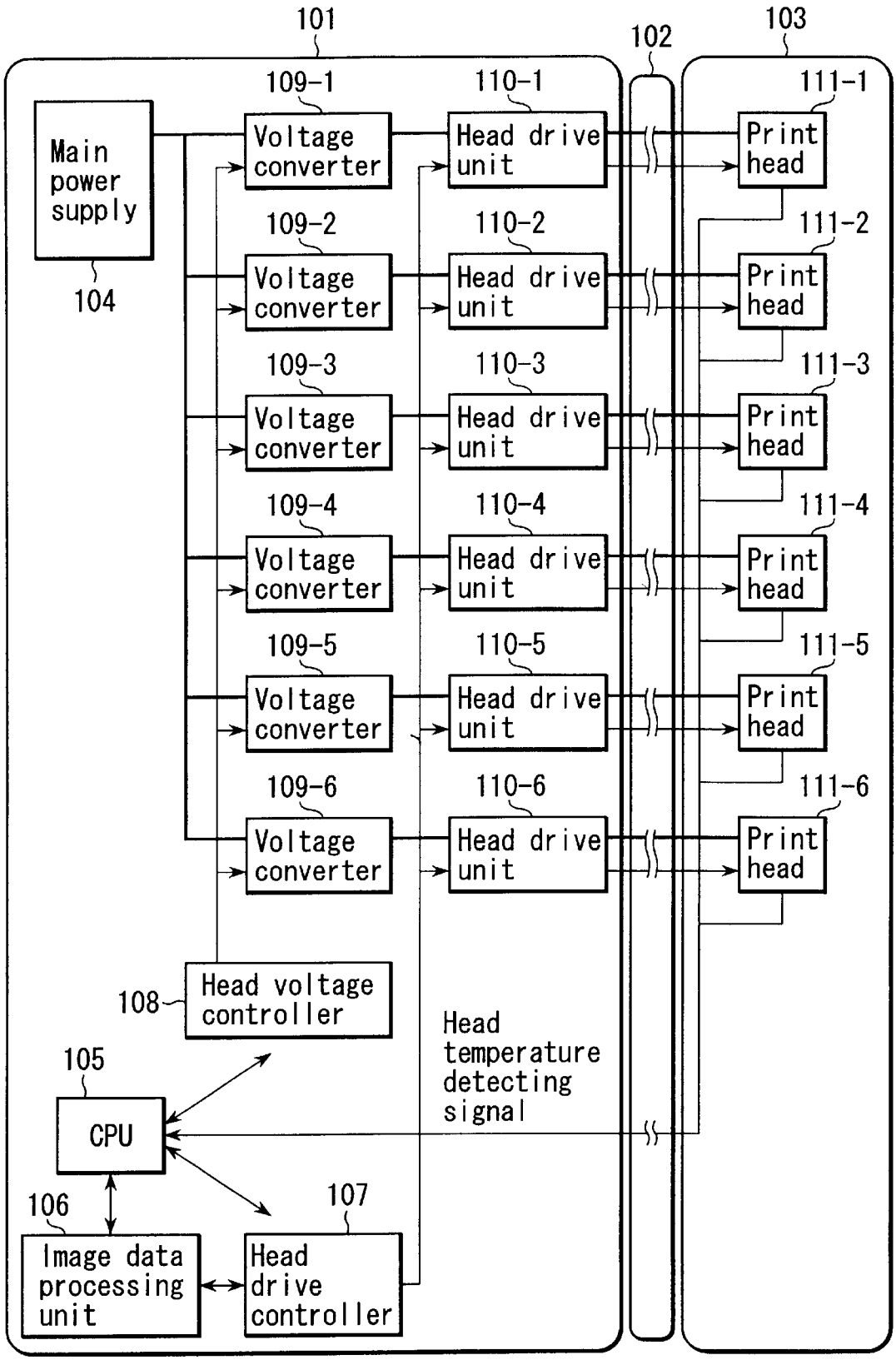
FIG. 1 PRIOR ART
FIG. 1 is a block diagram mainly showing a hardware arrangement of an inkjet printer according to a prior art.
Figure 2:
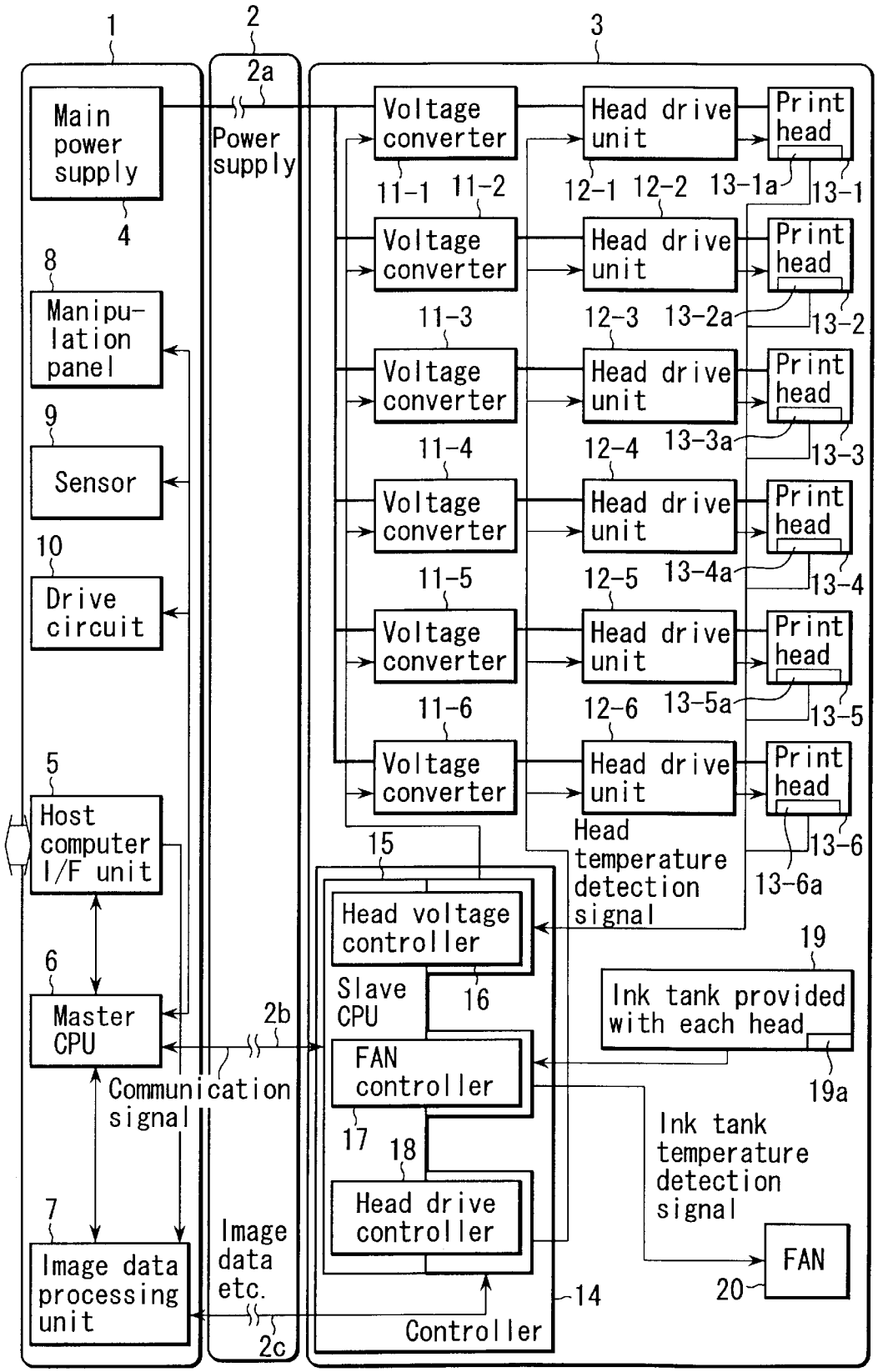
FIG. 2 is a block diagram mainly showing a hardware arrangement of an inkjet printer according to an embodiment of the present invention.

First, FIG. 2 shows a basic hardware arrangement of an inkjet printer according to the embodiment of the present invention. The hardware arrangement and operation of the inkjet printer will be described below in detail.

Note that a sheet transport system (a sheet transport motor and a circuit for driving the motor) and a carriage drive system (a carriage motor and a circuit for driving it) that do not directly relate to the characteristic portion of the embodiment are not shown in FIG. 2, and the description there of is also omitted.

In FIG. 2, the inkjet printer has a printer main body 1 connected to a carriage 3 through a cable 2 so as to freely communicate therewith.

First, the printer main body 1 has a main power supply 4 and a master CPU 6 disposed therein. A host computer I/F unit 5, an image data processing unit 7, a manipulation panel 8, various sensors 9, and various drive circuits 10 are connected to the master CPU 6.

A microcomputer is composed of the master CPU 6, a ROM (not shown), in which programs for the various modes of the printer are stored, and a RAM (not shown), in which data is temporarily stored. The cable 2 is composed of a material that does not interfere with the movement of the carriage 3. The cable 2 includes power supply lines 2*a*, communication signal lines 2*b*, and image data signal lines 2*c*.

The carriage 3 has a controller 14, six print heads 13-1 to 13-6 for six colors acting as recording colors, head drive units 12-1 to 12-6 for the print heads 13-1 to 13-6, and voltage converters 11-1 to 11-6 which act as a voltage generating unit and each of which is disposed thereon.

The controller 14 of the carriage 3 includes a slave CPU 15, a head voltage controller 16 arranged in association with the slave CPU 15, a fan controller 17 arranged in association with the slave CPU 15, and a head drive controller 18 arranged in association with the slave CPU 15.

In addition to the above components, the carriage 3 includes an ink tank 19 disposed to each of the print heads 13-1 to 13-6 and a fan 20. The temperature detectors 13-1*a* to 13-6*a* and 19*a* are disposed to each of the print heads 13-1 to 13-6 and to each of the ink tanks 19 corresponding thereto.

Operation of the inkjet printer arranged as mentioned above will be described below.

The master CPU 6 is connected to the image data processing unit 7 and the host computer I/F unit 5 and further to the slave CPU 15, and the like mounted on the carriage 3, and act as a controller therefor. That is, the master CPU 6 performs predetermined communication between it and the slave CPU 15 in the controller 14 on the carriage 3 side through the communication signal lines 2*b* that constitute the cable 2. Predetermined commands, status, for example, are transmitted and received between the master CPU 6 and the slave CPU 15 here. Exemplified as the commands are, for example, a print start/end command, a control command for controlling a load (fan), and the like in the carriage 3, a query command for the sensors (amounts of inks remaining in ink tanks), and the like.

The image data processing unit 7 receives image information transmitted from a host computer (not shown) through the host computer I/F unit 5. The image data processing unit 7 creates image data (raster data), which is supplied to the print heads 13-1 to 13-6, from the image information. The image data created by the image data processing unit 7 is supplied to a head drive/control unit 18 on the carriage 3 side through the image data signal lines 2*c* constituting the cable 2.

The main power supply 4 supplies a voltage to a carriage motor, a sheet transport motor, the respective drive circuits 10 provided with the printer, and the like. Further, the main power supply 4 supplies a voltage of, for example, 38 V to the carriage 3 through the power supply lines 2*a* constituting the cable 2. Note that while it is assumed that a head drive circuit is 38 V, it goes without saying that the voltage is by no means limited thereto.

That is, this means that power supply lines according to the number of heads are not necessary, and for example, two kind of power supply lines for 40 V and 20 V are wired from the main power supply 4. When the voltage value set by the head voltage controller 16 is 38 V, the drive voltage is generated from the voltage supplied from the power supply line for 40 V. When the voltage value set by the head voltage controller 16 is 10 V, the drive voltage is generated from the voltage supplied from the power supply line for 20 V.

In addition to the above arrangement, a user issues commands for print, and the like through the manipulation panel 8. The various drive circuits 10 include various circuits for driving the carriage drive motor and the sheet drive motor. The various sensors 9 include a sheet detection sensor and the like.

On the carriage 3 side, the slave CPU 15 drives and controls the head voltage controller 16, the fan controller 17, and the head drive/control unit 18 based on a command supplied from the master CPU 6 through the communication signal lines 2*b*.

The head drive/control unit 18 calculates a drive timing signal for driving each of the print heads 13-1 to 13-6 based on the image data created by the image data processing unit 7. Then, the head drive/control unit 18 supplies the drive timing signal to each of the head drive units 12-1 to 12-6 provided with the print heads 13-1 to 13-6.

The head voltage controller 16 calculates a head drive voltage value based on the head temperature detection signal supplied from each of the print heads 13-1 to 13-6 or the commands from the master CPU 6. The head voltage controller 16 supplies the head drive voltage value to each of the voltage converters 11-1 to 11-6 provided with the print heads 13-1 to 13-6 respectively.

The voltage converters 11-1 to 11-6 are provided with the respective print heads 13-1 to 13-6, respectively. The voltage converters 11-1 to 11-6 convert the voltage of 38 V supplied through the power supply line 2*a* of the cable 2 into a head drive voltage corresponding to each of the print heads 13-1 to 13-6 based on the head drive voltage value supplied from the head voltage controller 16.

That is, in the inkjet printer according to the embodiment, the head drive voltages supplied to the respective print heads 13-1 to 13-6 are generated by the voltage converters 11-1 to 11-6 and the head voltage controller 16 which was described above.

In general, inks used in inkjet printers have different ink ejection characteristics depending upon the properties and amount of pigments contained therein. Thus, the voltage converters 11-1 to 11-6 may be previously designed according to the ejection properties, and the like of the inks to be used.

Alternately, when it is desired to change driving characteristics for each ink, the ink color information of the print heads 13-1 to 13-6 is supplied from the master CPU 6 to the slave CPU 15 through communication when the power of the printer is gone into. The drive voltage of each of the print heads 13-1 to 13-6 may be controlled by the head voltage controller 16 using this information. In the latter case, it is not necessary to supply the ink color information to the print heads themselves.

The head drive units 12-1 to 12-6 are provided with the respective print heads 13-1 to 13-6, and each of the print heads 13-1 to 13-6 is driven based on the drive timing signal supplied from the head drive/control unit 18 in the controller 14.

In this embodiment, all the six print heads 13-1 to 13-6 are designed similarly, provided with versatility, and eject inks of K, C, M, LC, LM, and Y, respectively. The respective print heads 13-1 to 13-6 eject inks in predetermined amounts at predetermined timing in response to the drive timing signals supplied from the head drive units 12-1 to 12-6 and the drive voltages supplied from the voltage converters 11-1 to 11-6.

As described above, in the inkjet printer according to the embodiment, the voltage converters 11-1 to 11-6, which generate the drive voltages of the print heads 13-1 to 13-6, are mounted on the carriage 3. With this arrangement, it is sufficient for the main power supply 4 disposed on the printer main body 1 side to supply the drive voltage having only one kind of voltage value (for example, 38 V). As a result, only one set of the power supply lines 2*a* is needed in the cable 2 regardless of the number of the print heads 13-1 to 13-6.

Further, the voltage converters 11-1 to 11-6 for generating the drive voltages of the print heads 13-1 to 13-6 are mounted on the carriage 3 together with the print heads 13-1 to 13-6. With this arrangement, the distances from the print heads 13-1 to 13-6 to the voltage converters 11-1 to 11-6 are shortened. As a result, a voltage drop caused by the resistance and inductance components of the cable 2 (especially the power supply line 2*a*) themselves can be suppressed.

Further, signal responsiveness is improved, thereby a print pattern related that the voltage is changed abruptly can be coped with.

Figure 3:
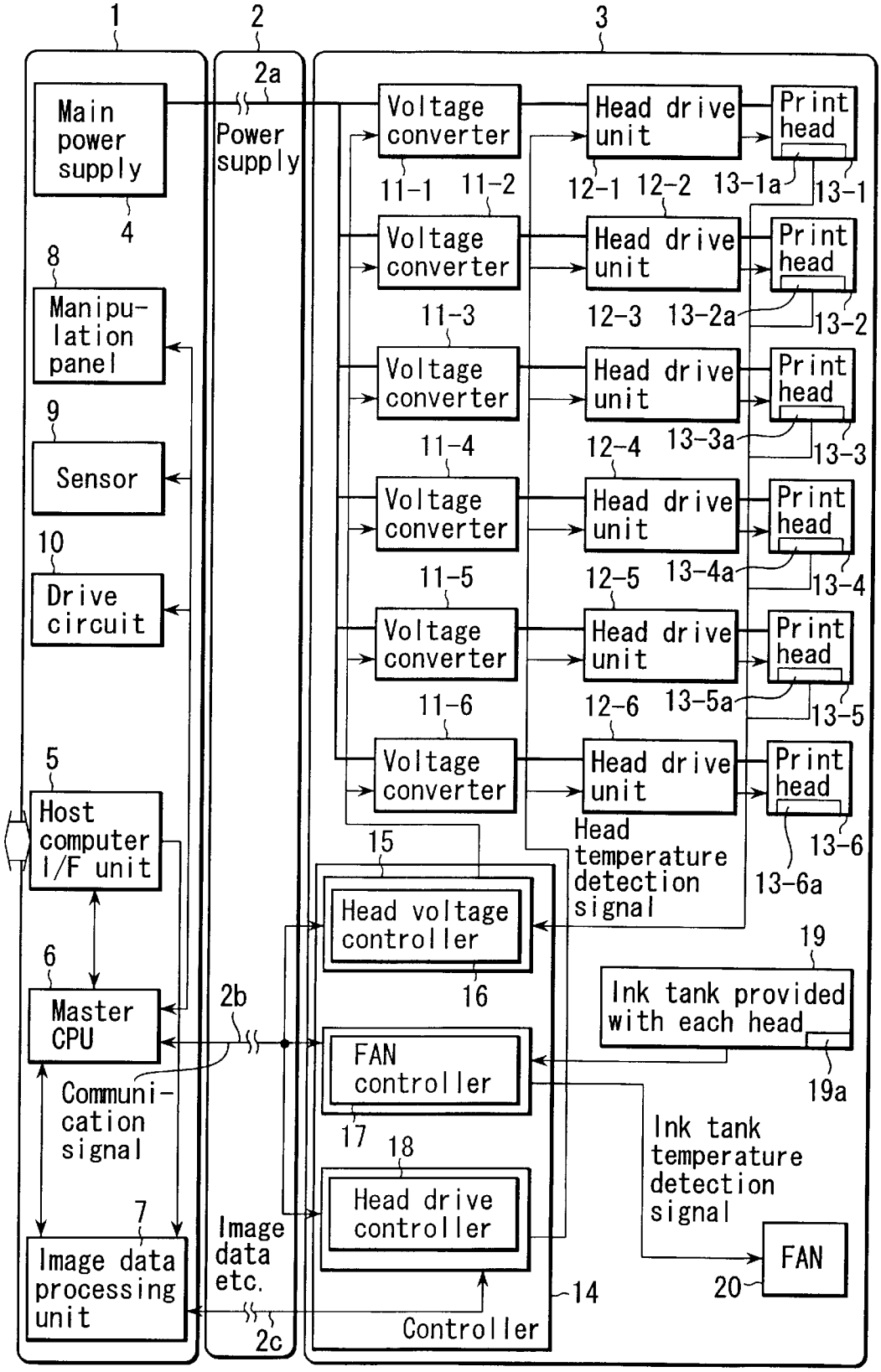
FIG. 3 is a block diagram mainly showing a hardware arrangement of an inkjet printer according to a transformable example of the embodiment of the present invention.

Next, a transformable example of the inkjet printer according to the embodiment will be described with reference to FIG. 3. In this improved example, the same reference numerals as used in FIG. 2 are used in FIG. 3 to denote the same arrangements, and overlapping description will be omitted. In FIG. 3, the previous embodiment is improved in that the controller 14 of the carriage 3 does not include a slave CPU.

In this arrangement, predetermined communication is executed between the head voltage controller 16, the fan controller 17, and the head drive/control unit 18, which are disposed in the controller 14, and the master CPU 6 on the printer main body 1 side. That is, operation similar to that of the above embodiment is performed. That is, in this transformable example, the master CPU 6 directly controls the respective units in the controller 14 of the carriage 3.

Figure 4:
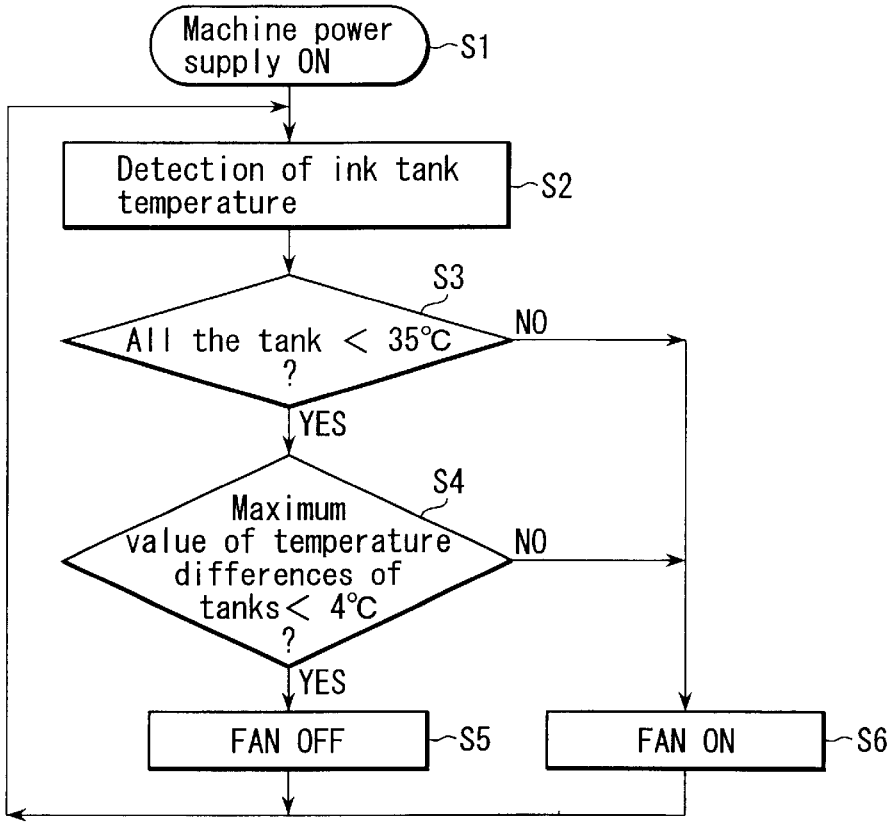
FIG. 4 is a flowchart showing a sequence for driving and controlling a fan of the inkjet printer according to the embodiment.

Next, the control of the fan 20 in the carriage 3 of the inkjet printer according to the aforementioned embodiments will be described with reference to FIG. 4.

When a power supply switch of the printer (machine) is turned on (step S1), and the fan controller 17 detects the temperatures of the ink tanks 19 (step S2). Then, it is determined whether or not the temperatures of the ink tanks 19 of all the print heads 13-1 to 13-6 are lower than 35° C. (step S3). The temperature of even any one of all the ink tanks is higher than 35° C., the fan 20 is turned on (step S6).

In contrast, when the temperatures of the ink tanks 19 of all the print heads 13-1 to 13-6 are less than 35° C., it is determined whether or not the maximum value of the temperature differences between the temperatures of the respective ink tanks 19 is higher than 4° C. (step S4). When the maximum value is higher than 4° C., the fan 20 is turned on (step S6).

In contrast, when the maximum value is less than 4° C., the fan 20 is turned off (step S5).

Figure 5:
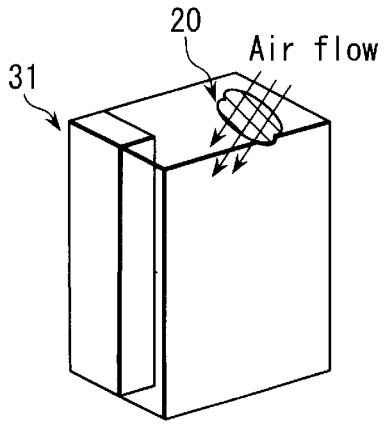
FIG. 5 is a view showing the layout of the fan 20 and heat sink 31.

Note that the layout of the fan 20 is as shown in FIG. 5. The fan 20 supplys outside air into the heat sink 31 as shown in FIG. 5.

The carriage 3 has a member having a heat radiating action called a heat sink 31 disposed thereon, in addition to the fan 20. This heat sink 31 radiate heat breaked out in the voltage converter. The heat radiating area of the carriage 3 is increased by the heat sink 31 connected to a casing of the carriage 3, thereby the heat radiating efficiency of the carriage 3 can be increased.

In general, when the heat generated in the carriage is radiated only by the heat sink 31, the heat sink 31 must have a large capacity to satisfy requirements. However, since the inkjet printer of this embodiment employs the fan 20 together with the heat sink 31, the cooling effect of the heat sink 31 is increased by the outside air supplied thereto by the fan 20, and using the housing of the carriage 3 as the heat sink 31, the size of the heat sink 31 can be greatly reduced and further the carriage 3 itself can be reduced in size as well as the cost thereof can be decreased.

Further, the disposition of a heating section below the carriage 3 can uniformly distribute the temperature in the interior of the carriage 3. Further, as described above, it is also possible to prevent the deterioration of image quality due to the difference of densities between respective colors by controlling the fan 20 by recognizing the temperature differences between respective ink tanks.

Figure 6:
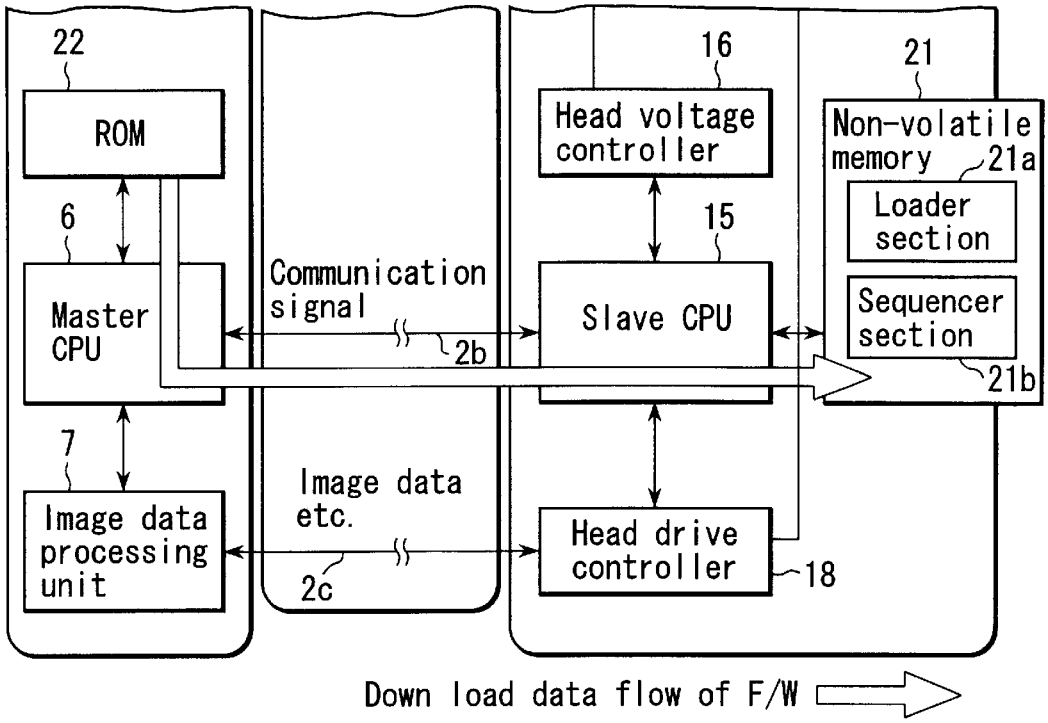
FIG. 6 is a partially enlarged view of the hardware arrangement shown in FIG. 2.
Figure 7:
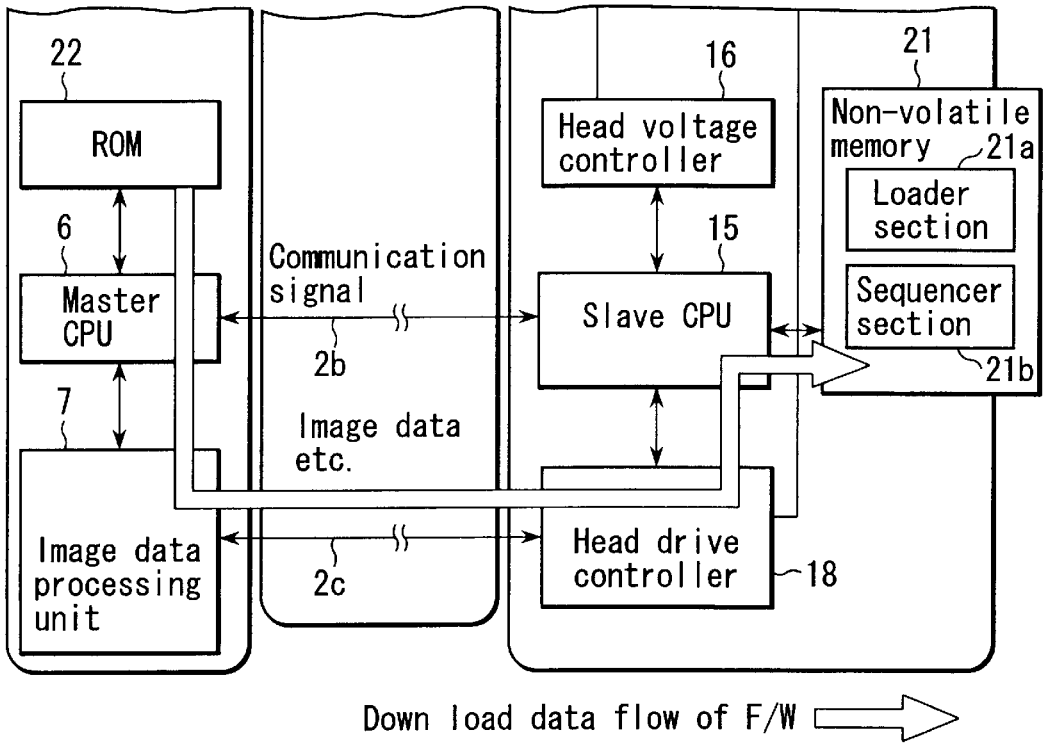
FIG. 7 is a partially enlarged view of the hardware arrangement shown in FIG. 2.

Next, a method of upgrading the firmware of the slave CPU 15 in the embodiment will be described with reference to FIGS. 6 and 7.

In the embodiment, the firmware of the slave CPU 15 is stored in a non-volatile memory 21 connected to the slave CPU 15. The non-volatile memory 21 includes a sequencer section 21*b* which stores a program for controlling and a loader section 21*a* which stores a program for upgradeing the program stored in the sequencer section 21*b*. Two methods can be employed to upgrade the program stored in the sequencer section 21*b*.

One of the methods employs the communication signal lines 2*b*. In this case, new firmware read by the master CPU 6 from a ROM 22 is supplied to the slave CPU 15 through the communication signal lines 2*b*, and the firmware in the sequencer section 21*b* of the nonvolatile memory 21 is upgraded by the slave CPU 15 (refer to FIG. 6).

The other method employs the image data signal lines 2*c*. In this case, the new firmware read by the master CPU 6 from the memory 22 is supplied to the slave CPU 15 through the image data signal lines 2*c*, and the firmware in the sequencer section 21*b* of the non-volatile memory 21 is upgraded by the slave CPU 15 (refer to FIG. 7).

Note that when the number of the image data lines is larger than that of the communication signal lines 2*b* and the image data lines have a higher transfer speed, the latter method is more advantageous. A flash memory, an EEPROM, and the like can be employed as the non-volatile memory 21.

Here, the effects achieved by the aforementioned embodiment can be summarized as described below.

That is, conventionally, a voltage that is set to a higher level to cover a voltage drop caused in the power supply lines must be supplied from a printer main body to a carriage side. This requires to increase the capacity of a main power supply for the power consumed uselessly in the power supply lines, thereby a cost is increased. In this regard, the embodiment can overcome this disadvantage because the drive voltages for driving the print heads are not supplied through the power supply lines but are individually generated in the carriage 3.

Conventionally, a drive voltage requires a long time to rise and fall its waveform due to the resistance and inductance components of the power supply lines, which deteriorates the responsiveness of a signal and makes it difficult for the signal to follow a print speed, thereby a print density is lowered and made uneven. In this regard, the inkjet printer of the embodiment can overcome this disadvantage because the drive voltages for driving the respective print heads are not supplied through the power supply lines but are individually generated in the carriage 3, and the distance from the voltage generating unit to the print heads is short.

Further, conventionally, since a relatively high voltage and current change in a high through rate, a large amount of electromagnetic noise is produced from the power supply lines, adversely affects the measurement of radiated noise, causes signals transmitting through the the power supply lines to interfere with each other, and disturbs the waveforms of the signals, thereby print control operation is made difficult because of the same reason (a relatively high voltage and current change in a high through rate, a large amount of electromagnetic noise is produced from the power supply lines). This embodiment can also overcome this disadvantage.

Further, conventionally, when voltage values are set according to the temperatures in print heads, it is necessary to transmit the temperature values of the print heads (signals output from thermistors) to a printer main body. In this case, when the temperature values of the print heads are transmitted through long cables, because the temperature values are analog values, the affect of noise or a voltage drop is generated. Thus, there is a possibility that significant print failure arises because the accurate temperatures of the print heads cannot be found. This embodiment can also overcome this disadvantage.

Conventionally, many power supply lines and control signal lines are used in the power supply lines, and a cost is increased thereby. In this respect, the embodiment can greatly reduce the number of voltage supply lines regardless of the number of the print heads.

Further, no drive voltage generating unit is disposed in each print head, it is possible to suppress an increase in the temperatures of the print heads themselves.

Furthermore, since the voltage generating unit is disposed on the carriage to generate drive voltages independently of the print heads, it is possible to design the head drive voltages according to the ink ejection characteristics of the every print head while maintaining the versatility of the print heads.

While the embodiment of the present invention has been described above, the present invention is by no means limited thereto and it goes without saying that various improvements and modifications can be made without departing from the gist of the present invention. For example, the present invention can be also applied to copy machines, facsimiles, composite machines, and the like having a print function, in addition to printers as discrete devices. Further, the present invention can be applied to a case where a simple color recording head and three-color multi-recording head are mounted on a carriage.

According to the present invention, there can be provided an inkjet printer capable of maintaining the versatility of a plurality of recording heads, reducing the number of cables and recording an image having desired high quality while realizing simultaneous print executed by the recording heads.

More specifically, it is possible to reduce the number of voltage supply lines, and the like that constitute a cable by disposing a voltage generating unit, which generates a head drive voltage according to each of a plurality of inkjet heads from a voltage supplied from a main power supply, on a carriage side.

Further, simultaneous printing executed by a plurality of recording heads can be realized by permitting the voltage generating unit to optionally set a drive voltage to each inkjet head and to optionally convert the set voltage regardless of a voltage supplied from the main power supply.

Further, an image having a desired high quality to which temperature information is added can be printed by providing a head temperature detector with each inkjet head.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printer comprising:

a carriage that has a plurality of print heads mounted thereon and that reciprocates with respect to a print medium;

a printer main body having a main power supply;

a cable that establishes electric conduction between the main power supply and the plurality of print heads;

a voltage generating unit that is disposed on the carriage and that generates head drive voltages according to the plurality of print heads from a voltage supplied from the main power supply;

a fan that supplies air into the carriage;

a plurality of ink tanks that are respectively disposed in the carriage in correspondence with the print heads, and that contain ink respectively supplied to the print heads;

a plurality of ink temperature detectors that are respectively disposed in correspondence with the plurality of ink tanks, and that each detect at least one of a temperature of one of the ink tanks and a temperature of the ink in said one of the ink tanks; and a fan controller that controls driving of the fan such that the fan is driven when a difference between a maximum value and a minimum value of a plurality of temperatures detected by the plurality of ink temperature detectors is larger than a predetermined value.

2. A printer comprising:

a carriage that has a plurality of print heads mounted thereon and that reciprocates with respect to a print medium;

a printer main body having a main power supply;

a cable that establishes electric conduction between the main power supply and the plurality of print heads;

a voltage generating unit that is disposed on the carriage and that generates head drive voltages according to the plurality of print heads from a voltage supplied from the main power supply;

a fan that supplies air into the carriage;

a plurality of ink tanks that are respectively disposed in the carriage in correspondence with the print heads, and that contain ink respectively supplied to the print heads;

a plurality of ink temperature detectors that are respectively disposed in correspondence with the plurality of ink tanks, and that each detect at least one of a temperature of one of the ink tanks and a temperature of the ink in said one of the ink tanks; and a fan controller that controls driving of the fan such that the fan is driven when any one of a plurality of temperatures detected by the plurality of ink temperature detectors is larger than a predetermined temperature.

* * * * *